US006733548B2

(12) United States Patent
Rasmussen et al.

(10) Patent No.: US 6,733,548 B2
(45) **Date of Patent: *May 11, 2004**

(54) SHIMMERING CANDLE CREAM

(76) Inventors: Johna L. Rasmussen, 3101 W. Leota, North Platte, NE (US) 69101; Leslie Ann Johns, 2610 Sunset Dr., North Platte, NE (US) 69101

( * ) Notice: Subject to any disclaimer, the term of this patent is extended or adjusted under 35 U.S.C. 154(b) by 0 days.

This patent is subject to a terminal disclaimer.

(21) Appl. No.: 10/179,305

(22) Filed: Jun. 26, 2002

(65) Prior Publication Data

US 2002/0152672 A1 Oct. 24, 2002

Related U.S. Application Data

(63) Continuation-in-part of application No. 10/033,800, filed on Jan. 3, 2002.
(60) Provisional application No. 60/267,489, filed on Feb. 9, 2001.

(51) Int. Cl.[7] ..... C10L 5/00; C11C 5/00
(52) U.S. Cl. ..... 44/275; 431/288
(58) Field of Search ..... 44/275; 431/288

(56) References Cited

U.S. PATENT DOCUMENTS

| | | | | | |
|---|---|---|---|---|---|
| 21,706 | A | | 10/1858 | Tatum | |
| 1,954,659 | A | | 4/1934 | Will | |
| 1,958,462 | A | | 5/1934 | Baumer | |
| 3,385,649 | A | | 5/1968 | Hicks | |
| 3,702,495 | A | * | 11/1972 | Renoe | 29/428 |
| 3,819,342 | A | | 6/1974 | Gunderman et al. | |
| 4,714,496 | A | * | 12/1987 | Luken et al. | 106/270 |
| 4,826,428 | A | * | 5/1989 | Lam | 431/291 |
| 5,843,194 | A | | 12/1998 | Spaulding | |
| 5,910,005 | A | * | 6/1999 | Scherr | 431/126 |
| 5,939,005 | A | * | 8/1999 | Materna | 264/255 |
| 6,019,804 | A | | 2/2000 | Requejo et al. | |
| 6,063,144 | A | | 5/2000 | Calzada et al. | |
| 6,171,103 | B1 | * | 1/2001 | Orlandi | 431/295 |
| 6,200,129 | B1 | * | 3/2001 | Sullivan et al. | 431/126 |
| 6,491,517 | B2 | * | 12/2002 | Freeman et al. | 431/291 |
| 6,503,285 | B1 | * | 1/2003 | Murphy | 44/275 |
| 2001/0001706 | A1 | * | 5/2001 | Orlandi | 431/289 |
| 2002/0064743 | A1 | * | 5/2002 | Freeman et al. | 431/288 |
| 2002/0185410 | A1 | * | 12/2002 | Travis-Pence | 206/736 |

FOREIGN PATENT DOCUMENTS

| | | |
|---|---|---|
| GB | 2590 | 3/1893 |

* cited by examiner

*Primary Examiner*—Margaret B. Medley
(74) *Attorney, Agent, or Firm*—Richard C. Litman

(57) ABSTRACT

A candle composition in creamy liquid form spreads evenly to assume the shape and size of any candle-safe container. The composition hardens after being heated by a wick and subsequently cooled after the wick is extinguished.

9 Claims, 3 Drawing Sheets

SHIMMERING CANDLE CREAM

CROSS-REFERENCE TO RELATED APPLICATION

This application is a continuation-in-part of application Ser. No. 10/033,800 (Attys. Docket no. 19716.00) filed Jan. 3, 2002, which claims the benefit of U.S. Provisional Patent Application Ser. No. 60/267,489, filed Feb. 9, 2001.

BACKGROUND OF THE INVENTION

1. Field of the Invention

The present invention relates to illuminating devices. More specifically, the present invention is drawn to a candle, candle kit and method for making a candle.

2. Description of Related Art

Before Edison perfected the incandescent light bulb, candles were necessary to produce needed light. Candles manufactured in the pre-Edison era were usually of utilitarian design. The candles were made of tallow (animal fat) or beeswax and, when lit, produced unpleasant odors and a fair amount of smoke. Today, in the post-Edison era, candles are viewed as decorative items which contribute to the "feng shui" (aesthetic quality) of the immediate environment. Candle lovers sustain an industry dedicated to fabricating candles in a vast array of shapes, sizes, colors and scents. In spite of this varied array, often a candle lover may desire a candle of a particular shape, color and/or scent that is not available. Or, perhaps the candle lover may want to reproduce a favorite shape in a different color. Further, many of the candles made today are made from paraffin and are prone to produce unpleasant smoke and odors when lit. A kit that would permit a user to easily and efficiently produce a candle using a pourable cream to create the exact desired candle configuration and scent would certainly be an advancement in the art.

The prior art is replete with patented candle structures and methods for making the same. Examples of the above are disclosed in U.S. Pat. No. 21,706 (Tatum), U.S. Pat. No. 1,954,659 (Will) and U.S. Pat. No. 1,958,462 (Baumer). The instant patents do not contemplate using a pourable cream or tailoring the scent of the candle.

U.S. Pat. No. 3,385,649 (Hicks) discloses a kit for making a candle. The patentee contemplates the use of solid granules which must be melted before the candle can be formed.

U.S. Pat. No. 3,819,342 (Gunderman et al.) discloses a composition for making a transparent candle. There is no disclosure which would allow a user to determine candle configuration.

U.S. Pat. No. 5,843,194 (Spaulding) discloses a candle made from a pourable gel. The gel does not comprise vegetable-derived material.

U.S. Pat. No. 6,019,804 (Requejo et al.) shows a process for making a compression molded candle. This process is not designed to be employed by the individual candle user.

U.S. Pat. No. 6,063,144 (Calzada et al.) discloses a candle made of non-paraffin material. The candle material is solid at room temperature and there is no contemplation for providing a kit for individual use.

British Patent 2590 discloses an illuminant for use in lamps which will be in liquid form when the lamp is in use and which will solidify when the lamp is extinguished. No provision is set forth to shape the illuminant as a candle.

None of the above inventions and patents, taken either singly or in combination, is seen to disclose a method for making a candle and a kit therefor as will subsequently be described and claimed in the instant invention.

SUMMARY OF THE INVENTION

The instant invention, dubbed "Candle Cream", is a unique and versatile addition to the competitive candle market. Candle Cream may be poured into a container of any shape and size and will immediately conform to the shape of the container. Candle Cream is fabricated in a variety of colors and scents to appeal to different aesthetic tastes. A user may mix colors and/or scents to create his/her own special blend.

Unlike paraffin wax candles, candles made from Candle Cream burn cleanly, emitting only scents which are added thereto. A special feature of the instant invention allows Candle Cream to be stored and shipped in a fluid, creamy state. Thus, no pre-melting is required. Candle Cream remains in a fluid state in the chosen container until heated. Upon cooling, subsequent to the initial heating, Candle Cream will solidify, assuming the shape of the aforementioned chosen container.

Candle Cream can also be used as a simmering potpourri or the like. The composition is simply poured in a receptacle to which heat is provided (electric, t-light burner, candle warmer, etc.). Heating the composition will cause aromas to be emitted. As above, the composition will harden upon cooling.

Accordingly, it is a principal object of the invention to provide a package of materials which will enable an individual to fashion custom-made candles.

It is another object of the invention to provide a package of materials which will enable an individual to fashion candles in any desired shape.

It is a further object of the invention to provide a package of materials which will enable an individual to fashion candles, which will, when lit, emit a desired aroma.

Still another object of the invention is to provide a package of materials which will enable an individual to fashion candles which are safe and environmentally friendly.

It is an object of the invention to provide improved elements and arrangements thereof for the purposes described which are inexpensive, dependable and fully effective in accomplishing their intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
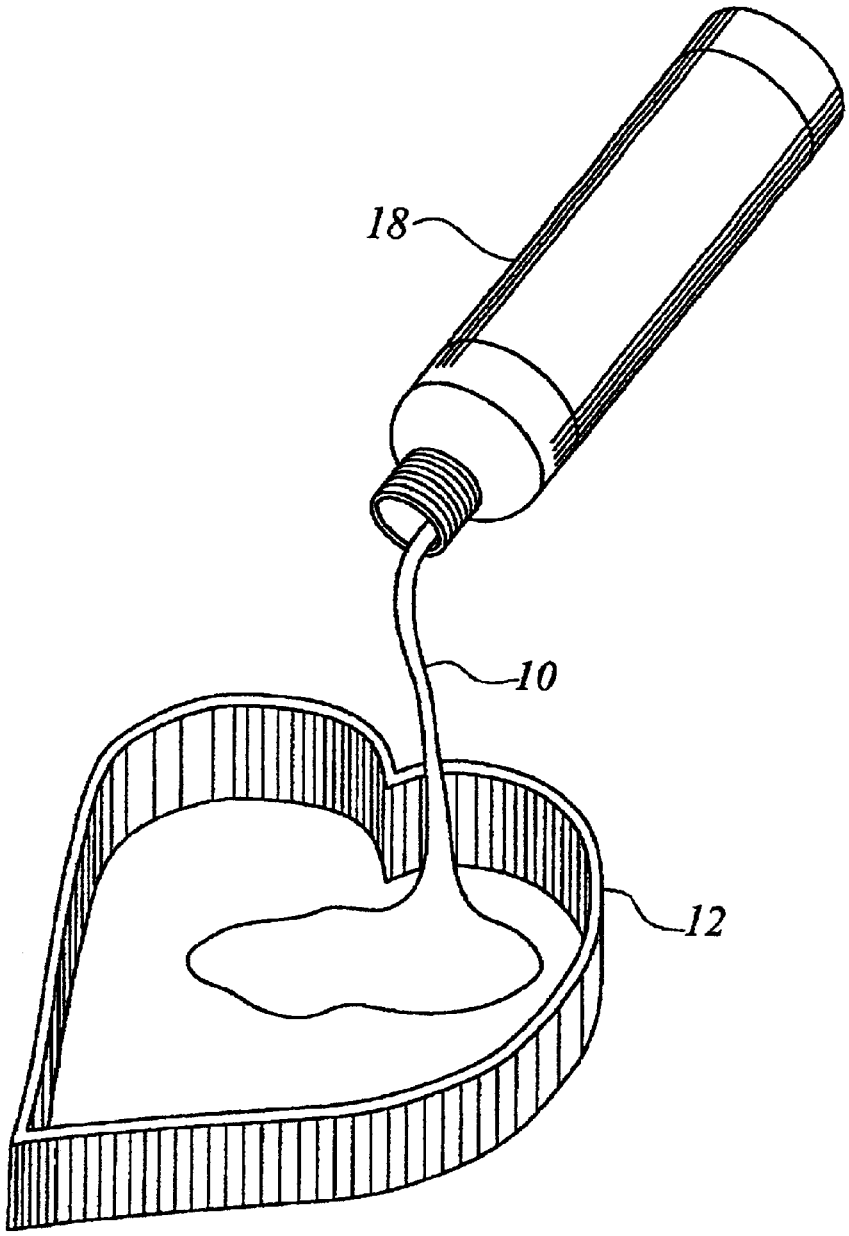
FIG. 1 is an environmental, perspective view of a shimmering candle cream according to the present invention.
Figure 2:
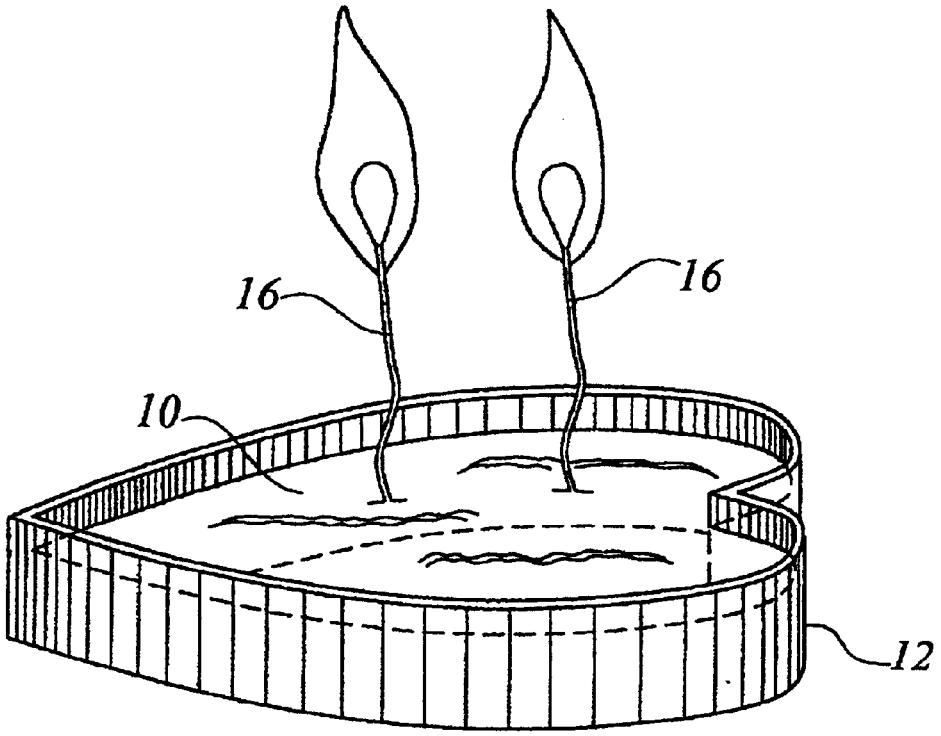
FIG. 2 is a perspective view of a candle formed by the shimmering candle cream according to the present invention.
Figure 3:
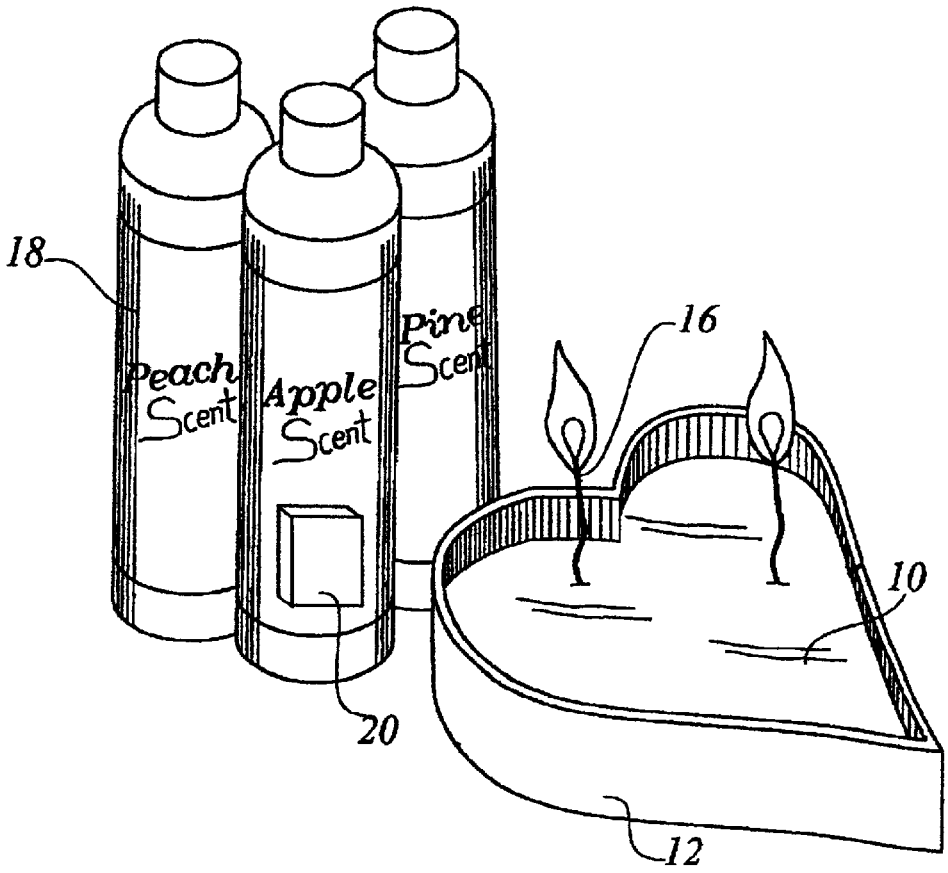
FIG. 3 is a perspective view of a shimmering candle cream packaged in bottles according to the present invention.

The present invention comprises a blended, fluid composition generally indicated in FIG. 1 at 10. The blended, fluid composition is made solely from suitable vegetable-derived raw material and includes 31–51 parts by weight of one hundred per cent partially hydrogenated soybean oil, 20–40 parts by weight of stearic acid (dry measure) and 20–40 parts by weight of creamy vegetable liquid shortening. Although soybean oil is preferred, it should be noted that any suitable vegetable shortening could be utilized. Because it is fluid, candle composition 10 will spread evenly when poured into a candle-safe container 12. This unique feature allows the composition to assume the shape of any desired, suitable container thereby allowing a user to determine the shape and size of the candle. Though of heart-shaped configuration, it is emphasized that container 12 may be of any desired shape or size. Composition 10 remains in a fluid state until heated. After being initially heated, the upper surface of composition 10 will solidify or harden when cooled and retain the shape of its container. FIG. 2 illustrates candle composition 10 after disposition in container 12. Wicks 16 are provided to light the candle as is conventional in the art. Initially lighting wicks 16 will provide the heat which allows the composition to subsequently harden. Wicks 16 are fabricated from materials that contain no lead, zinc or tin. Composition 10 and wick 16 create a candle which is biodegradable, water soluble, cleaner burning and safer than the popular paraffin based candles. Furthermore, tests have shown that the candle of the instant invention burns thirty to fifty percent longer than comparable paraffin based candles. To further enhance the uniqueness of the invention, fine fragrance oils may be added to composition 10 so that pleasing aromas will be emitted when the candles made therefrom are lit. Color and glitter producing elements may also be added to the composition to add visual excitement.

As presently contemplated, Candle Cream may be packaged in receptacles 18 which may be colored to match the color of the particular Candle Cream. Also, receptacles 18 will be labeled to indicate the scent of the Candle Cream. A supply of wicks 20 will be separately packaged and attached to a respective receptacle 18.

It is to be understood that the present invention is note limited to the sole embodiments described above, but encompasses any and all embodiments within the scope of the following claims.

We claim:

1. A kit for fabricating a candle comprising:

a candle composition, said candle composition being in the form of a creamy liquid, wherein said creamy liquid is made solely from a blended, vegetable-derived material and wherein said blended, vegetable-derived material includes 31–51 parts by weight of one hundred percent partially hydrogenated soybean oil, 20–40 parts by weight of stearic acid (dry measure) and 20–40 parts by weight of creamy vegetable liquid shortening;

a receptacle, said candle composition being housed in said receptacle;

a package of candle wicks, said package of wicks attached to said receptacle.

2. A method of making a candle comprising the steps of:

providing a receptacle containing a creamy liquid candle composition, said creamy liquid composition being made solely from blended vegetable-derived materials, said blended vegetable derived material including 31–51 parts by weight of one hundred per cent partially hydrogenated soybean oil, 20–40 parts by weight of stearic acid (dry measure) and 20–40 parts by weight of creamy vegetable liquid shortening;

providing a container, said container having a shape and being fabricated of candle safe materials;

pouring said creamy liquid candle composition from said receptacle into said container such that said creamy liquid is evenly spread and assumes the shape of said container;

inserting a least one wick in said creamy liquid in said container;

igniting said wick to heat said creamy liquid in said container;

extinguishing said wick to allow said creamy liquid to cool and solidify.

3. A method of making a candle as recited in claim 2, further including the step of adding selected fragrance producing oils to said creamy liquid.

4. A kit for fabricating a candle as recited in claim 1 wherein said creamy liquid further includes selected fragrance producing oils.

5. A kit for fabricating a candle as recited in claim 4, wherein said creamy liquid further includes a selected coloring agent.

6. A kit for fabricating a candle as recited in claim 5, wherein said creamy liquid further includes glitter producing agents.

7. A method of making a candle as recited in claim 3, further including the step of adding a selected coloring agent to said creamy liquid.

8. A method of making a candle as recited in claim 7, further including the step of adding selected glitter producing agents to said creamy liquid.

9. A creamy liquid candle composition, said composition consisting of a blend of vegetable-derived materials, said blend include31–51 parts by weight of one hundred per cent partially hydrogenated soybean oil 20–40 parts by weight of stearic acid and 20–40 parts by weight of creamy vegetable liquid shortening.

* * * * *